US005531450A

United States Patent [19]

Lu et al.

[11] Patent Number: 5,531,450

[45] Date of Patent: Jul. 2, 1996

[54] DART BOARD MOUNTING STRUCTURE

[76] Inventors: Kuo-Hui Lu, 3F, No. 50, Lane 2, Sec. 2, Yan Jiow Yuann Rd.; Chin-Huang Peng, 4-4F, No. 31, Sung Chang Rd., both of Taipei, Taiwan

[21] Appl. No.: 441,746

[22] Filed: May 16, 1995

[51] Int. Cl.[6] ..... F41J 3/00

[52] U.S. Cl. ..... 273/348; 273/347

[58] Field of Search ..... 273/347, 348, 273/374, 376, 408, 407

[56] References Cited

U.S. PATENT DOCUMENTS

| | | | |
|---|---|---|---|
| 3,300,216 | 1/1967 | Haecker | 273/408 X |
| 3,894,736 | 7/1975 | Foley . | |
| 4,982,968 | 1/1991 | Foley . | |
| 5,193,817 | 3/1993 | Pan . | |
| 5,197,743 | 3/1993 | Hanson, Jr. | 273/408 X |

FOREIGN PATENT DOCUMENTS

| | | | |
|---|---|---|---|
| 3900137 | 7/1990 | Germany | 273/408 |
| 4302490 | 9/1993 | Germany | 273/408 |
| 817522 | 7/1959 | United Kingdom | 273/408 |
| 1020847 | 2/1966 | United Kingdom | 273/408 |

*Primary Examiner*—Paul E. Shapiro

*Attorney, Agent, or Firm*—Law Office of Steven M. Rabin

[57] ABSTRACT

A dart board mounting structure includes one or two symmetrical dart holders which may be freely connected to an upper side or lower side of a circumferential wall of the dart board. Notches are formed in the wall of the dart board for holding the dart holders. Each dart holder is a stepped board consisting of a higher step and a lower step. The higher step has a curved surface with one or two T-shaped legs. The lower step is connected to an elongated plate via a tear-off line. The elongated plate has a plurality of jaws, and rings are disposed between adjacent jaws. A plurality of pins corresponding to the rings are provided on the lower step abutting the higher step. A stop is provided at either sides of the plurality of pins for retaining the elongated plate after it is torn off the lower step and fitted on the pins.

11 Claims, 6 Drawing Sheets

DART BOARD MOUNTING STRUCTURE

BACKGROUND OF THE INVENTION (a) Field of the Invention

The present invention relates generally to a dart board mounting structure, and more particularly to a dart board with two symmetrical dart holders connected to an upper side or lower side thereof.

(b) Description of the Prior Art

There are many kinds of dart games. The most conventional dart board is made of cork material used in conjunction with darts having metal points. However these metal points may cause injury. Therefore, in recent years, a kind of honeycomb type dart boards with fine meshes or a kind of dart board with a multiplicity of posts, such as those disclosed in U.S. Pat. Nos. 3,894,736 and 4,982,968, have been used in cooperation with darts with plastic (rubber) points. In addition, there is also a U.S. Pat. No. 5,193,817which teaches a honeycomb type dart board with meshes having sound and light producing effects and automatic score calculation which are controlled by use of electric circuits.

But most of the conventional dart boards mentioned above fail to suggest a dart board with a holder structure for holding darts. In these dart boards, darts are allowed to stick in the dart board. After a period of time, the darts may be lost, and the meshes or the posts of the dart board may become deformed. Such a way of keeping darts by sticking them in the dart board is not proper, especially for darts with metal points, which may constitute a latent danger to young children.

The above-mentioned U.S. Pat. No. 5,193,817 does teach a dart board with a dart holder structure, in which a horizontal holder is provided at a lower side of the dart board. The holder is substantially elongated with hook pieces provided on both sides thereof for connecting to the lower side of the dart board. The holder has a plurality of open recesses for receiving the darts. But in this prior art, the holder is preassembled to the dart board and is directly attached to the bottom side of the outer frame of the dart board and cannot be freely disengaged therefrom. Such a dart board structure occupies space and may be easily damaged. Besides, it cannot be directly joined to the circular dart board and is not adapted for use with dart boards without outer frames.

SUMMARY OF THE INVENTION

A primary object of the present invention is to provide a dart board mounting structure with dart holders for keeping darts properly, which is convenient to assemble or disassemble and safe to use, wherein the dart holder of the present invention is configured to have a curved surface provided with one or two T-shaped legs which may be fitted into corresponding positioning notches formed in an upper side or lower side of a circumferential wall of the dart board, and the dart holder is provided with a plurality of jaws for holding darts.

Another object of the present invention is to provide a dart board mounting structure with dart holders to facilitate packaging and save space, wherein the dart holder is a stepped board having a higher step and a lower step, the lower step being connected to an elongated plate via a tear-off line, the elongated plate having a plurality of jaws with rings between adjacent jaws, the higher step being provided with corresponding pins so that the elongated plate may be fitted thereonto after it is disengaged from the lower step.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
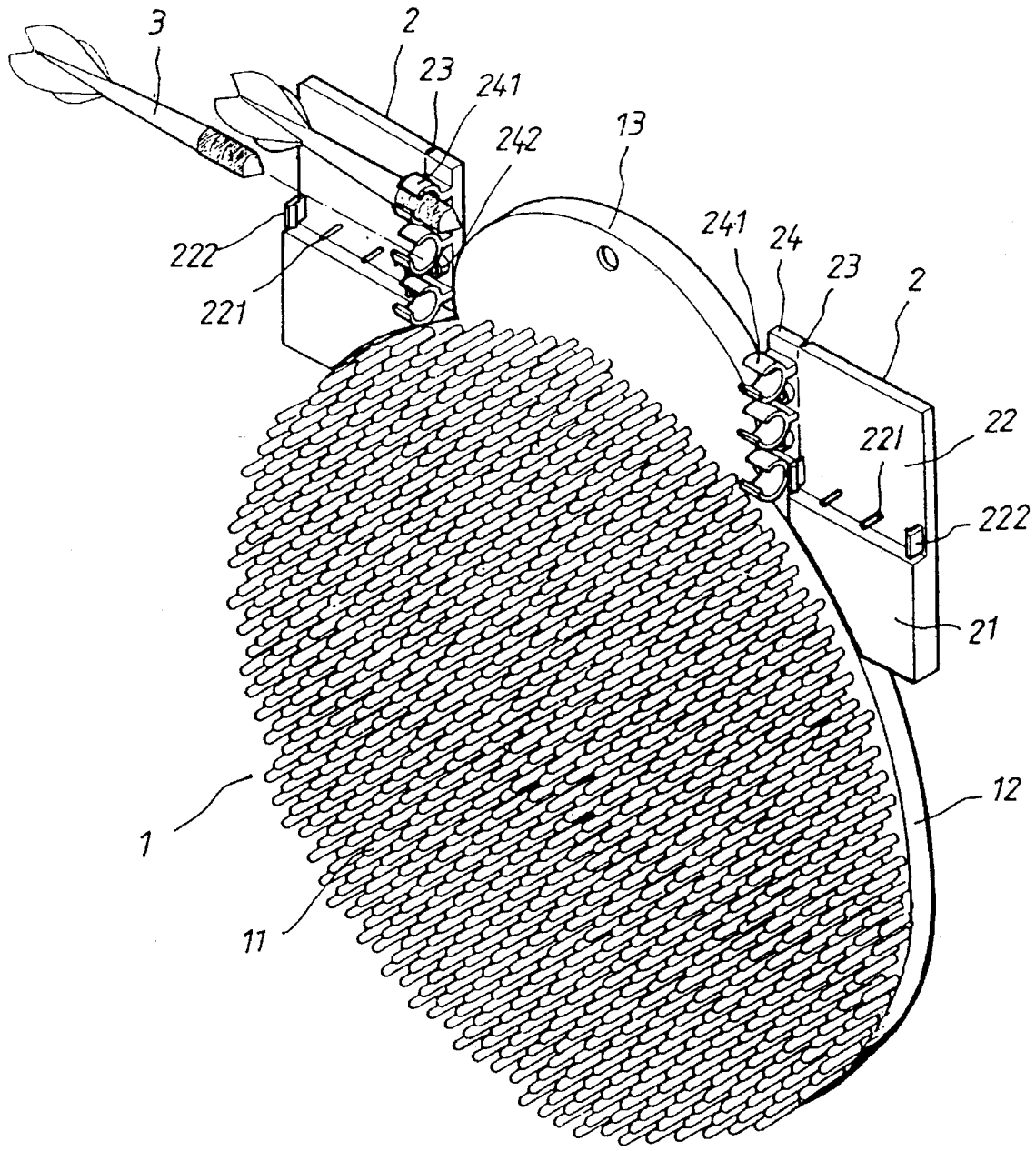
FIG. 1 is a perspective of the present invention in a packed state.

As shown in FIG. 1, the dart board mounting structure according to the present invention comprises a dart board 1 and two symmetrical dart holders 2. Although two dart holders 2 are provided in this preferred embodiment, it should be understood that a single holder 2 may also be employed.

Figure 2:
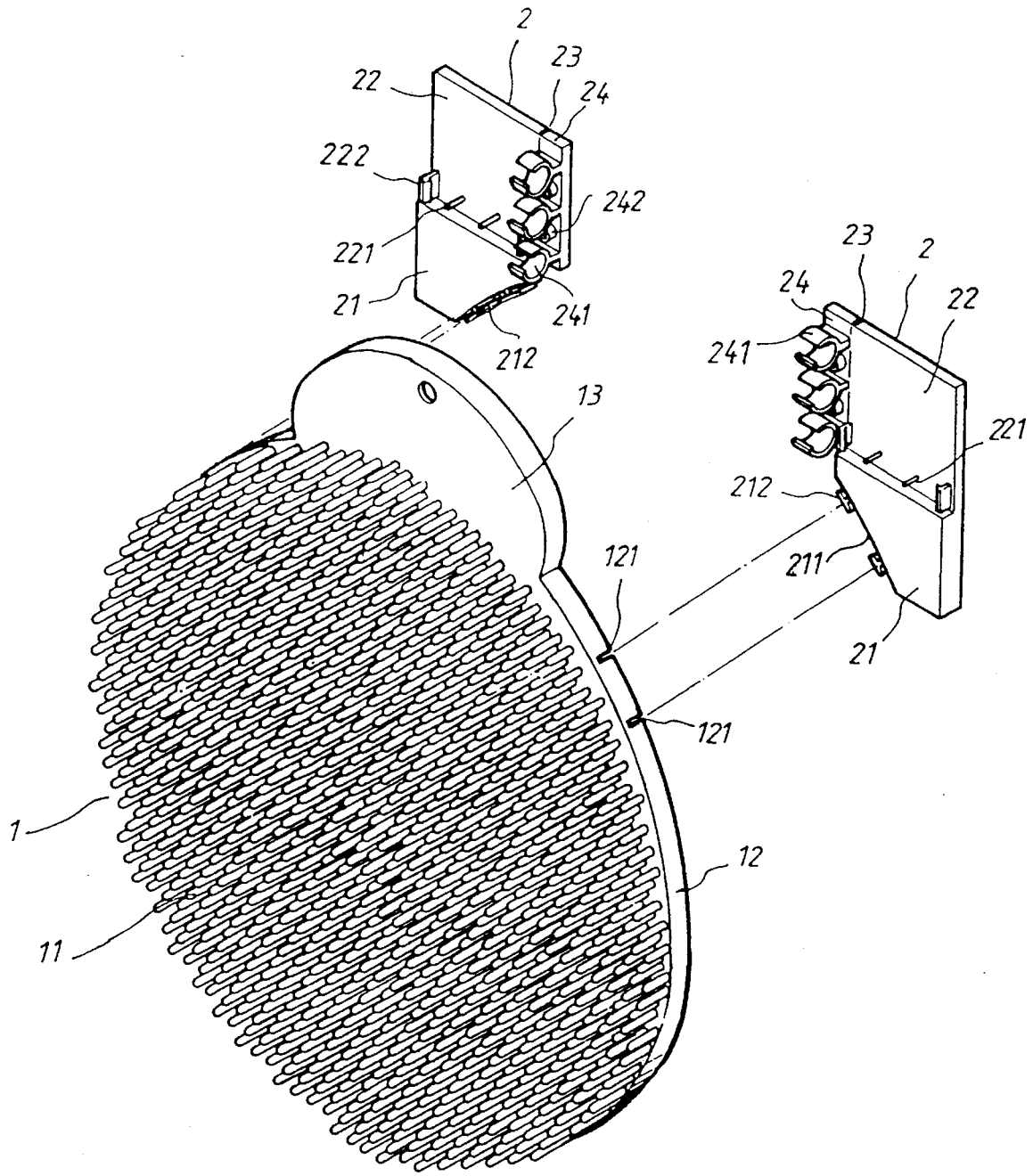
FIG. 2 is a perspective view of the present invention in a disassembled state.

The surface of the dart board 1 may be formed of cork or plastic material such as residual PE or HIPS materials produced after injection molding. These PE or HIPS materials are recyclable. The surface of the dart board 1 may be configured to be either a honeycomb type surface with fine meshes, a smooth surface, or one with posts 11 as that shown in the drawings, as long as darts 3 may be held therein. The dart board 1 according to the present invention has a circumferential wall 12, and a plurality of positioning notches 121 (as shown in FIG. 2) are provided in an upper side or lower side of the wall 12 or at any suitable position. An upper end of the dart board 1 is provided with a hook plate 13.

The dart holder 2 is a stepped board having a higher step 21 and a lower step 22. One side of the higher step 21 has a curved surface 211. One or two T-shaped legs 212 are provided on the curved surface 211. An outer side of the lower step 22 is connected to an elongated plate 24 via a tear-off line 23. The elongated plate 24 is provided with a plurality of jaws 241 thereon. Rings 242 are provided between two adjacent jaws 241. A plurality of pins 221 corresponding to the rings 242 are provided on the lower step 22 where it abuts the higher step 21. A stop 222 is disposed at either side of the plurality of pins 221 on the lower step 22.

Figure 3:
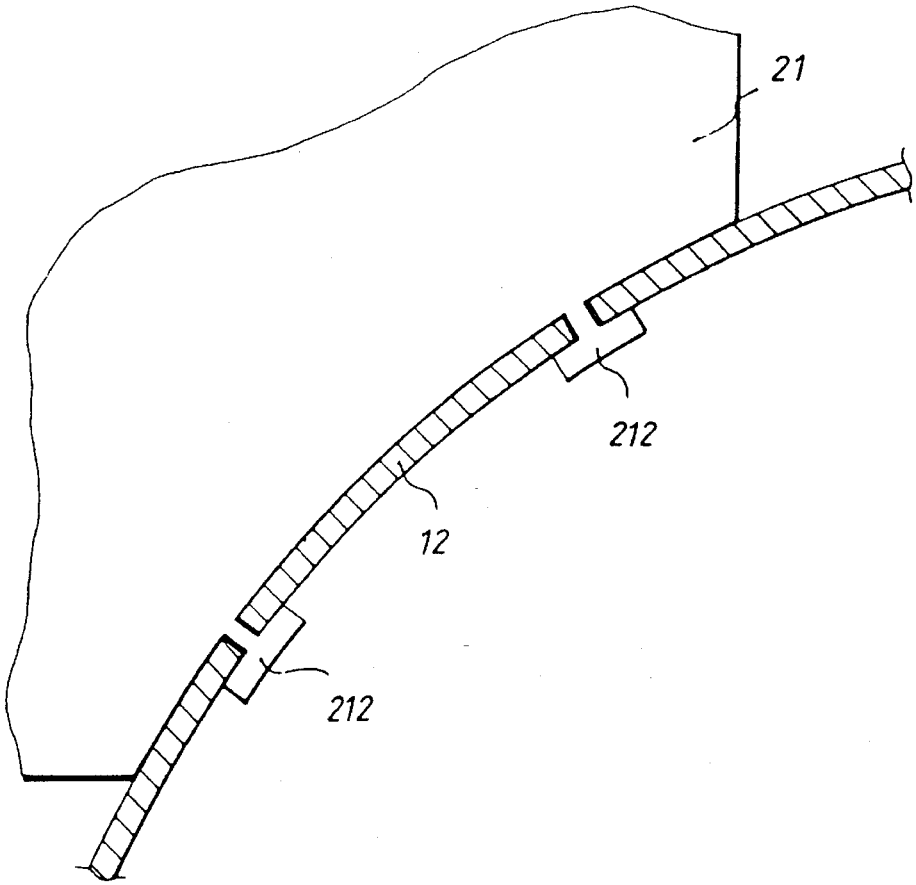
FIG. 3 is a sectional view of the dart board mounting structure according to the present invention in an assembled state.
Figure 4:
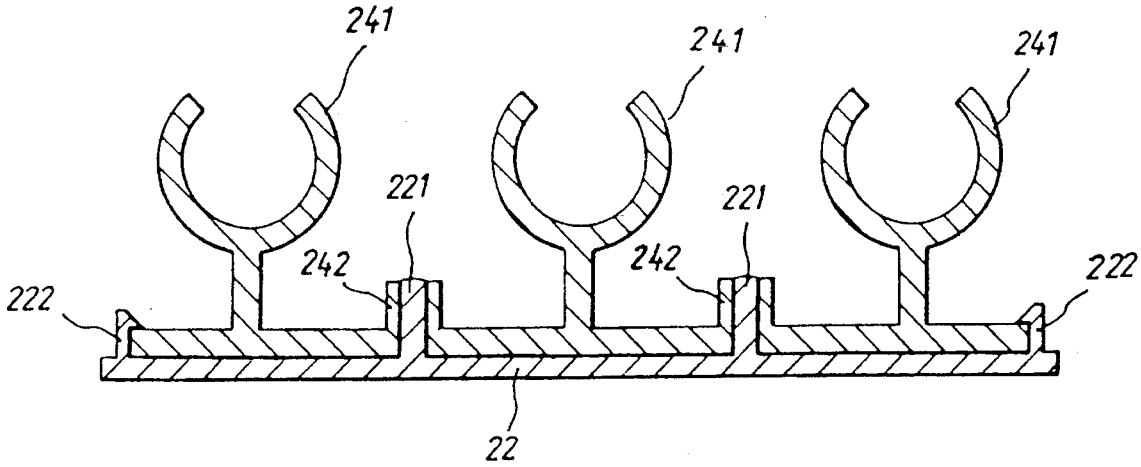
FIG. 4 is a cross sectional view of the elongated plate of the dart holder according to the present invention in an assembled state.
Figure 5:
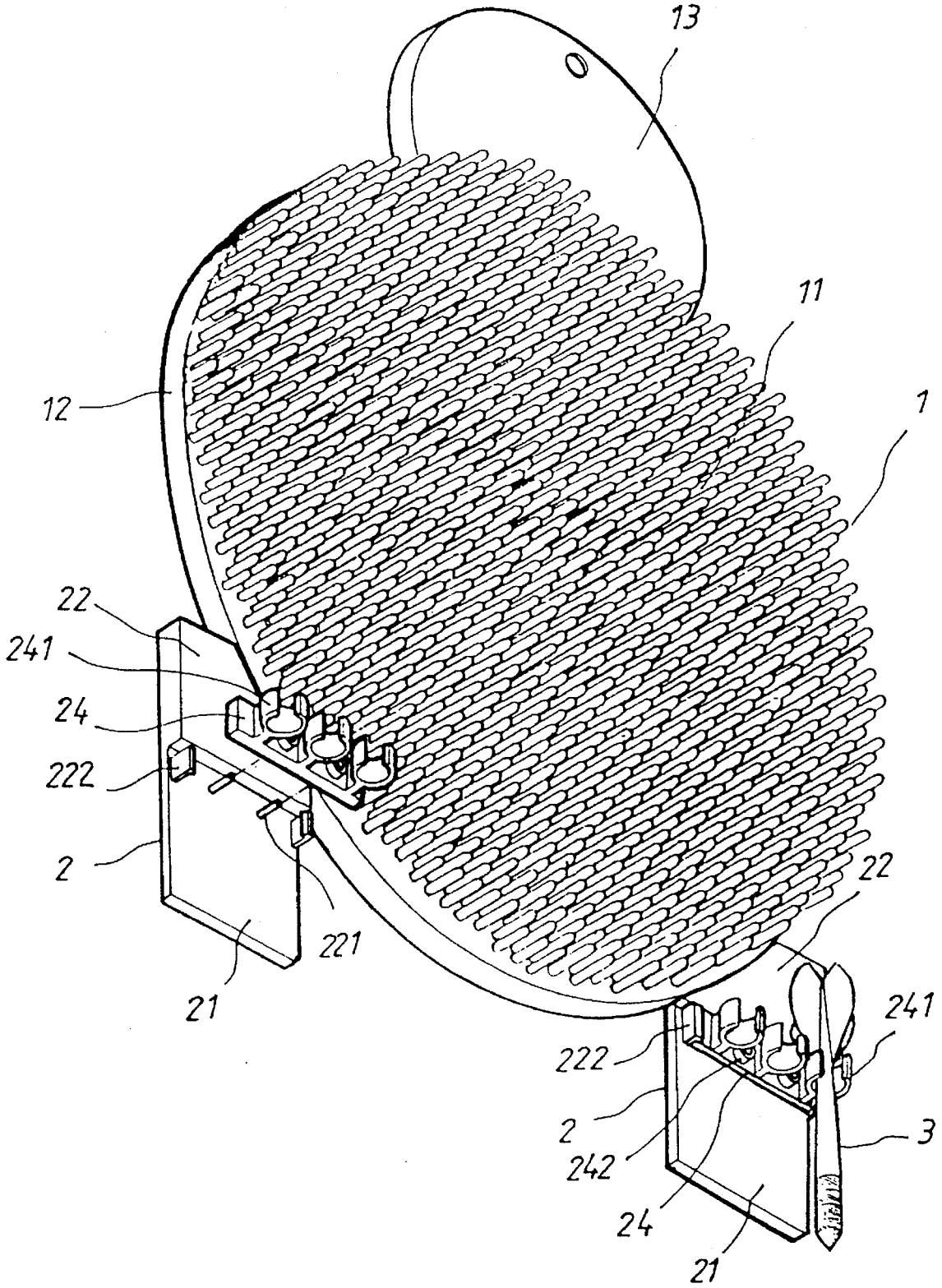
FIG. 5 is a perspective view of the present invention in an assembled state during use.

The dart holder 2 may be fitted onto the dart board 1 by means of its T-shaped posts legs 212 which are fitted into the positioning notches 121 in the circumferential wall 12 (see FIGS. 1 and 3). The darts 3 may then be horizontally fitted in the respective jaws 241 to be held therein. Such an arrangement facilitates packaging and saves space. During use, the dart holder 2 is taken down from the dart board 1, and the elongated plate 24 is torn off the dart holder 2 along the tear-off line 23. The elongated plate 24 is then arranged on the lower step 22 by fitting the rings 242 onto the corresponding pins 221 (see FIG. 4), and the elongated plate 24 is confined in position by the stops 222 at either side of the lower step 22. The whole dart holder 2 is then secured to the dart board 1 by inserting the T-shaped legs 212 into the positioning notches 121 at the lower side of the dart board 1 (see FIG. 5).

In another preferred embodiment of the present invention, the elongated plate 24 with the jaws 241 may be integrally formed on the dart holder 2, eliminating the step of tearing off the elongated plate 24 and fitting it onto the pins 221 of the dart holder 2. Furthermore, as mentioned above, instead of two dart holders 2, a single dart holder 2 may be mounted at the lower side of the dart board 1, and the dart holder 2 may be configured to have a larger width so as to include more jaws 241 for holding darts 3. It should be understood that such modifications fall within the scope of the invention.

Figure 6:
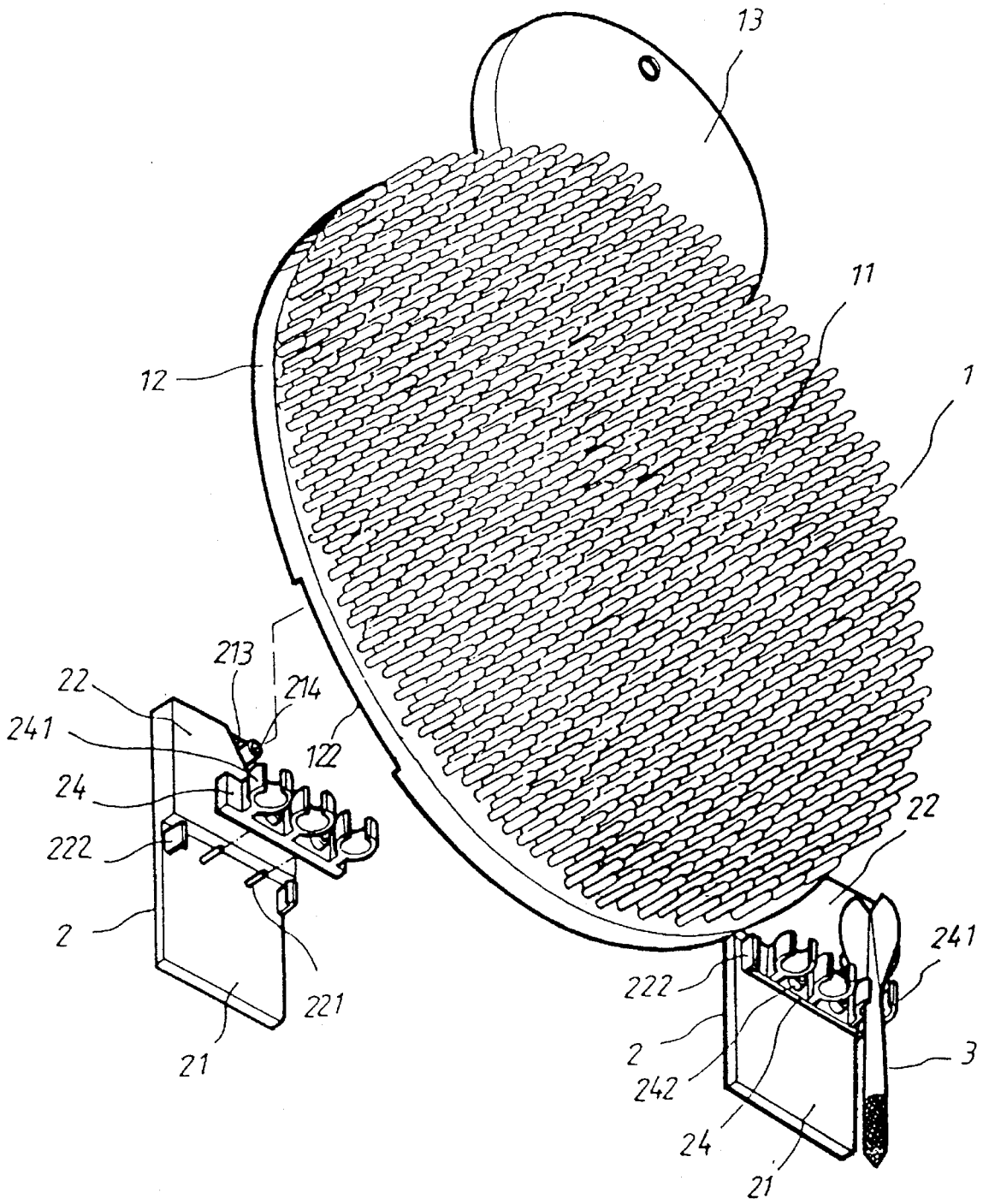
FIG. 6 is an exploded schematic view of a second preferred embodiment of the present invention, showing a different way of joining the dart holder and the dart board.
Figure 7:
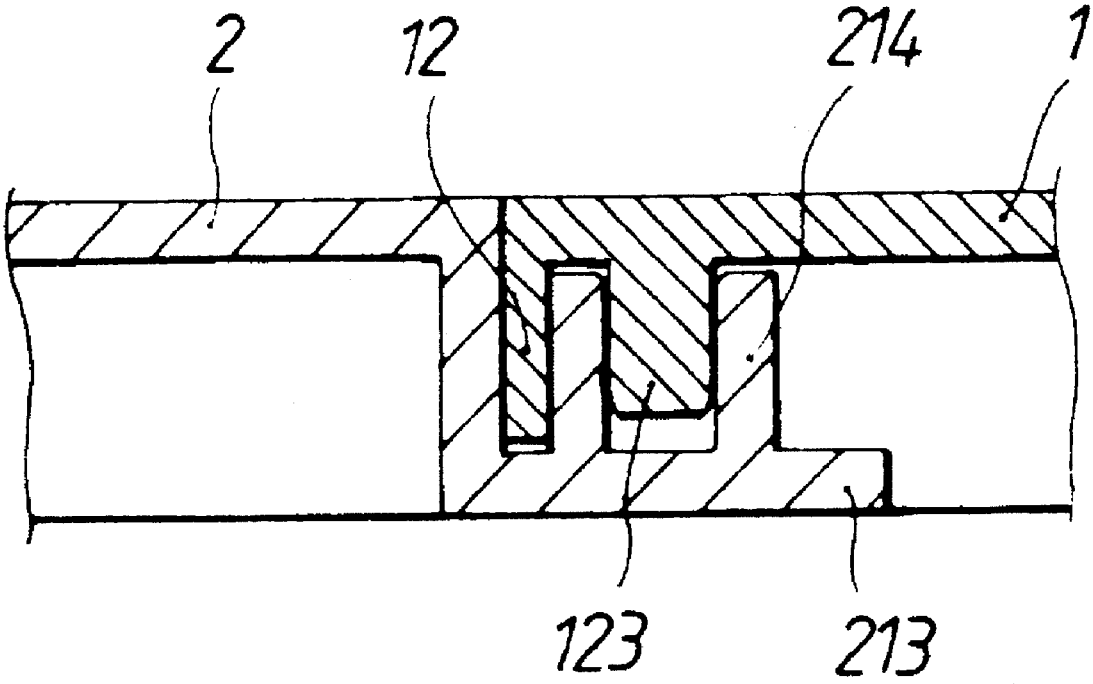
FIG. 7 is a partial sectional view of FIG. 6.

In addition, the circumferential wall 12 of the dart board 1 and the dart holder 2 may be joined together in the manner as shown in FIGS. 6 and 7, in which corresponding notches 122 are provided at a position of the circumferential wall 12; the notches 122 are provided with pins 123 on the inner walls thereof. As for the curved surface 211 of the dart holder 2, it is provided with an extended plate 213 having thereon circular posts 214 corresponding to the pins 123, so that the circular posts 214 may engage with the pin 123, eliminating the use of T-shaped legs 212 and positioning notches. Such simple modifications should be understood to fall within the scope of protection of the present invention.

Although the present invention has been illustrated and described with reference to the preferred embodiment thereof, it should be understood that it is in no way limited to the details of such embodiment but is capable of numerous modifications within the scope of the appended claims.

What is claimed is:

1. A dart board mounting structure including a dart board and at least one dart holder, said mounting structure comprising:

a dart board having a circumferential wall, said wall having a plurality of positioning notches provided at at least one of an upper side and a lower side thereof;

the dart holder substantially being a stepped board with a higher step and a lower step, said higher step having a curved surface at one side thereof, one or two T-shaped legs being provided on said curved surface, said lower step being connected to an elongated plate via a tear-off line, said elongated plate being provided with a plurality of jaws with a ring disposed between two adjacent jaws, a plurality of pins being correspondingly provided on said lower step abutting on said higher step;

wherein said T-shaped legs of said dart holder may be fitted into said positioning notches in said wall of said dart board to facilitate packaging and, during use, said dart board is taken down and said elongated plate is torn off said dart holder along the tear-off line and is arranged on said lower step of said dart holder by means of said rings fitted onto said pins, and said dart holder is then secured to a lower side of said dart board by means of said T-shaped legs which are inserted into said positioning notches in said wall of said dart board.

2. A dart board mounting structure as claimed in claim 1, wherein a stop is provided at either sides of said plurality of pins for restraining said elongated plate when said elongated plate is torn off said lower step and fitted onto said pins by means of said rings.

3. A dart board mounting structure comprising a dart board and at least one dart holder, said mounting structure comprising:

a dart board having a circumferential wall, said wall having a plurality of positioning notches provided at at least one of an upper side and a lower side thereof;

the dart holder substantially being a stepped board with a higher step and a lower step, said higher step having a curved surface at one side thereof, one or two T-shaded legs being provided on said curved surface, said lower step being integrally connected to an elongated plate;

wherein said T-shaped legs of said dart holder may be fitted into said positioning notches in said wall of said dart board to facilitate packaging and, during use, said dart board is taken down and said elongated plate is arranged on said lower step of said dart holder by means of said rings fitted onto said pins, and said dart holder is then secured to a lower side of said dart board by means of said T-shaded legs which are inserted into said positioning notches in said wall of said dart board.

4. A dart board mounting structure comprising a dart board and at least one dart holder, said mounting structure comprising:

a dart board having a circumferential wall, said wall having at least one positioning notch provided at least one of an upper side and a lower side thereof, said notch having an inner wall provided with pins;

the dart holder substantially being a stepped board with a higher step and a lower step, said higher step having a curved surface at one side thereof, said lower step being connected to an elongated plate via a tear-off line, said elongated plate being provided with a plurality of jaws with a ring disposed between two adjacent jaws, a plurality of pins being correspondingly provided on said lower step abutting on said higher step;

wherein said dart holder includes an extended plate which has a plurality of circular posts, whereby said circular posts may engage with said pins of said inner wall to hold said dart holder to said dart board; and wherein during use, said dart board is taken down and said elongated plate is torn off said dart holder along the tear-off line and is arranged on said lower step of said dart holder by means of said rings fitted onto said pins on said lower step.

5. A dart board device, comprising:

a dart board;

a stepped plate having a first step and a second step, said first step having means for mounting darts attached thereto, and said second step including means for securing said mounting means to said dart board;

wherein said dart board includes at least one area formed in a peripheral wall thereof that are shaped so as to connect to said securing means of said second step.

6. A dart board device as claimed in claim 5, wherein said means for securing includes T-shaped feet protruding from a curved wall of said second step;

wherein said areas of said peripheral wall are formed so as to accept said T-shaped feet to hold said stepped plate to said dart board.

7. A dart board device as claimed in claim 5, wherein said means for mounting darts is attached to said first step via a tear-off line.

8. A dart board device as claimed in claim 7, wherein said first step includes pins disposed proximate said second step and, said means for mounting darts includes rings adapted to receive said pins.

9. A dart board device as claimed in claim 8, wherein said first step includes stops disposed so as to engage said means for mounting darts when said means for mounting darts is fit onto said pins.

10. A dart board device as claimed in claim 5, wherein said means for mounting darts is integrally formed with said first step.

11. A dart board device as claimed in claim 5, wherein said second step includes an extended plate that is formed so as to engage with a rear surface of said peripheral wall of said dart board, said extended plate having receptacles thereon which engage with pins formed on said rear surface.

* * * * *